US006979792B1

(12) United States Patent
Tsai

(10) Patent No.: US 6,979,792 B1
(45) Date of Patent: Dec. 27, 2005

(54) KEYSTROKE STRUCTURE (1)

(76) Inventor: Lai Cheng Tsai, No. 127, Waitahsi St., Toucheng, Ilan (TW)

( * ) Notice: Subject to any disclaimer, the term of this patent is extended or adjusted under 35 U.S.C. 154(b) by 0 days.

(21) Appl. No.: 10/929,565

(22) Filed: Aug. 31, 2004

(51) Int. Cl.[7] ..... H01H 13/70

(52) U.S. Cl. ..... 200/344; 200/5 R; 200/17 R; 400/490; 345/168

(58) Field of Search ..... 200/344, 5 R, 200/5 A, 17 R, 18, 512; 400/490; 361/724; 345/168

(56) References Cited

U.S. PATENT DOCUMENTS

| | | | | | |
|---|---|---|---|---|---|
| 5,268,545 | A | * | 12/1993 | Bruner | 200/345 |
| 5,828,015 | A | * | 10/1998 | Coulon | 200/5 A |
| 5,924,553 | A | * | 7/1999 | Yeh | 200/344 |
| 5,973,281 | A | * | 10/1999 | Tsai | 200/344 |
| 6,088,219 | A | * | 7/2000 | Yanniello et al. | 361/657 |
| 6,156,985 | A | * | 12/2000 | Chiang | 200/344 |
| 6,340,803 | B1 | * | 1/2002 | Li | 200/344 |

* cited by examiner

*Primary Examiner*—K. Richard Lee
(74) *Attorney, Agent, or Firm*—Dennison, Schultz, Dougherty & MacDonald

(57) ABSTRACT

A keystroke structure (1) comprising a baseplate with insert holes are considerably spaced; the baseplate further comprises a membrane circuit board; an electrically conductive and round in shape resilient body is on the circuit board, a first key frame and a second key frame are on the rim of the resilient body; the first key frame and the second key frame comprise two protruding hinged arms at one end and two extending posts at the other end; the posts comprise a shaft lever respectively; the shaft levers can thread insert the holes on the hood frame; furthermore, the posts comprise a protruding tubes each where they are connected with the first key frame and the second key frame; the tubes comprise a through holes each which the hinged arms thread such that the first key frame and the second key frame can be connected in "Y" shape. A key cap is inserted on the first and the second key frame, while assembly, since the posts have only one end stretch out to the baseplate, the assembly is easier and faster, the structure is simpler to save manufacturing cost. The first and the second key frames are connected together to support each other, the supporting strength is stronger, the slide is smoother.

7 Claims, 6 Drawing Sheets

KEYSTROKE STRUCTURE (1)

BACKGROUND OF THE INVENTION

I. Field of the Invention

The present invention relates to a keystroke structure (1) and particularly, to a keystroke structure that can reduce assembling steps and be slidden smoothly.

II. Description of the Prior Art

Heretofore, it is known that notebook computers are much favored and extensively used because they are portable and highly functional in document and data processing. To improve portability, reduce size, thickness and weight for notebook computers, manufacturers are engaged in constant research and development. The thin-type keystroke structure currently used by notebook computer keypads, as shown in FIG. 1, is mostly a scissor-type (or bridging type) supporting structure between key cap and baseplate, which comprises:

a key cap wherein a cap post extends downward in the center of the downward extending cap cover; two horizontal cap sheets that extend down the inner wall on the same side and the two cap hooks that extend down the cap top on the other side, including a hook groove in the middle; two cap ribs that integrally extend with the inner top of the cap cover and in parallel with the cap sheets;

a bridge, which is formed by the interconnection between a post frame and a tenon frame, and in a moveable status; the end of the two parallel post levers of the post frame is a cylindrical end with a post hole in the center; two post levers are connected by two parallel post tenons to form a frame, the upper tenon is inserted in the hook groove; the tenon frame is also a frame structure, wherein the ends of the tenon levers on two sides form a tenon end whose central section extends vertically out of the tenon shaft and whose upper tenon shaft is located between the cap sheets and the cap ribs; furthermore, a tenon core extends toward the center of each tenon lever and can be threaded into the post hole; two parallel tenon beams are integrally connected between two tenon levers to form a frame body;

a bridgeboard, which is located at key on/off switch and comprises board holes; board lugs are formed vertically at a location corresponding to the lower tenon shafts, board grooves are provided to insert the board lugs; furthermore, the lower sections of the post tenons extend and double bend to form board hooks;

a key ring board made of soft and resilient materials, which is provided at a location corresponding to each cap post and whose top serves as a convex point;

a membrane circuit and circuit contacts provided at a location corresponding to each convex point;

a baseplate, which is formed by connecting bridgeboard, key ring boards and membrane circuit.

Conventional structure has the following disadvantages:

1. Complex components and high manufacturing cost.
2. In installation, the post frames of the bridgeboard and the shaft levers on both ends of tenon frame are required to sleeve on the bridgeboard, which makes assembling a troublesome and complex job.
3. Board grooves are in open status, which tends to cause the post levers and the shaft levers on the tenon levers to drop off.
4. The bridgeboard is in rectangular shape and key ring board is in cylindrical shape. As a result, bridgeboard cannot restrict the movement of the key ring board, thus causing the key ring board to move when pressed.

SUMMARY OF THE INVENTION

It is therefore a primary object of the invention to provide a keystroke structure (1) comprises a baseplate with insert holes are considerably spaced; the baseplate further comprises a membrane circuit board; an electrically conductive and round in shape resilient body is on the circuit board, a first key frame and a second key frame are on the rim of the resilient body; the first key frame and the second key frame comprise two protruding hinged arms at one end and two extending posts at the other end; the posts comprise a shaft lever respectively; the shaft levers can thread insert the holes on the hood frame; furthermore, the posts comprise a protruding tubes each where they are connected with the first key frame and the second key frame; the tubes comprise a through holes each which the hinged arms thread such that the first key frame and the second key frame can be connected in "Y" shape. A key cap is inserted on the first and the second key frame, while assembly, since the posts have only one end stretch out to the baseplate, the assembly is easier and faster, the structure is simpler to save manufacturing cost. The first and the second key frames are connected together to support each other, the supporting strength is stronger, the slide is smoother.

It is still an object for the invention to provide a keystroke structure (1) in which the baseplate 10 comprises an inverse "U" shape hood frame on the insert hole to prevent drop-off due to slippage after the shaft levers are inserted in.

It is still another object for the invention to provide a keystroke structure (1) in which the end surfaces of the first key frame and the second key frame are in arc shape, they not only can increase supporting strength but also fit well with the resilient body to the restrict resilient body, without any displacement by pressing.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 1:
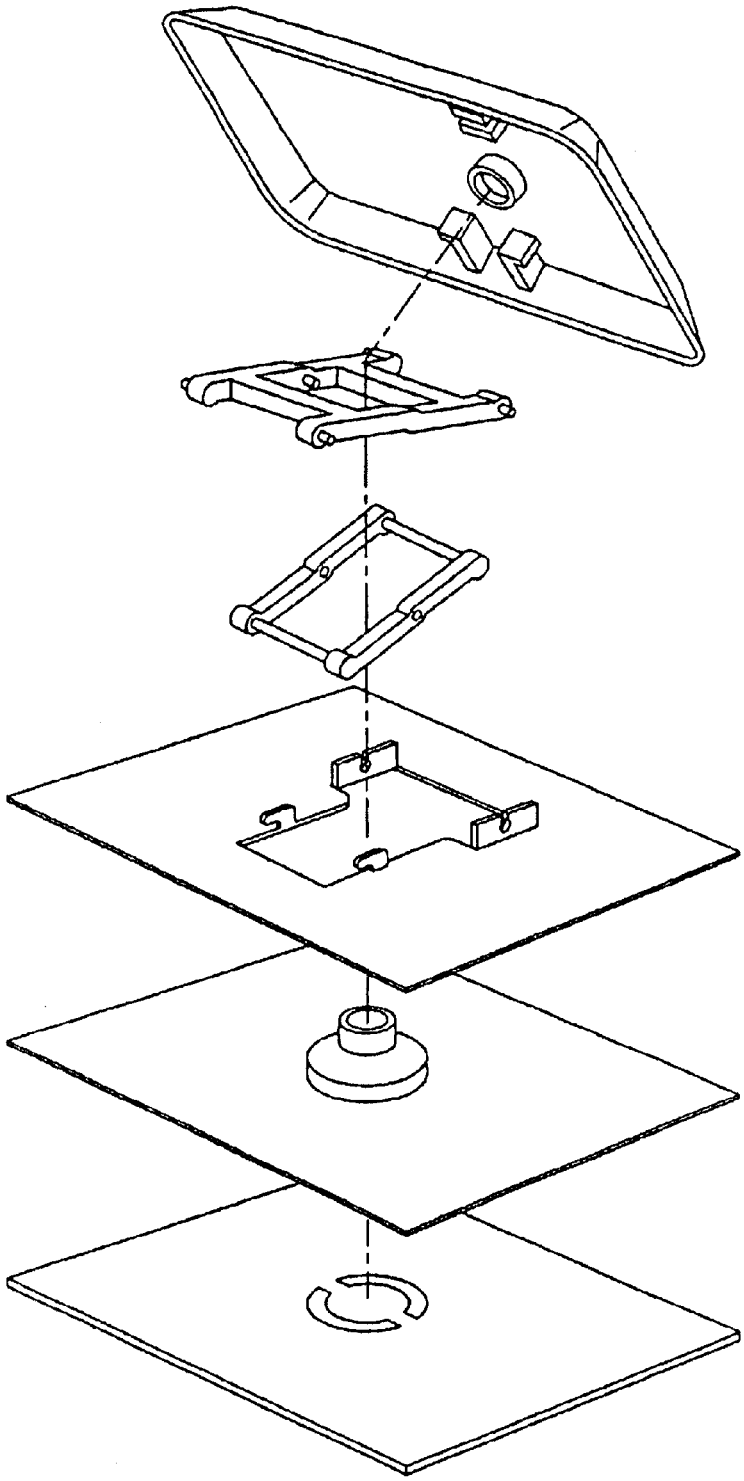
FIG. 1 PRIOR ART
FIG. 1 is an assembly view of the prior art.
Figure 2:
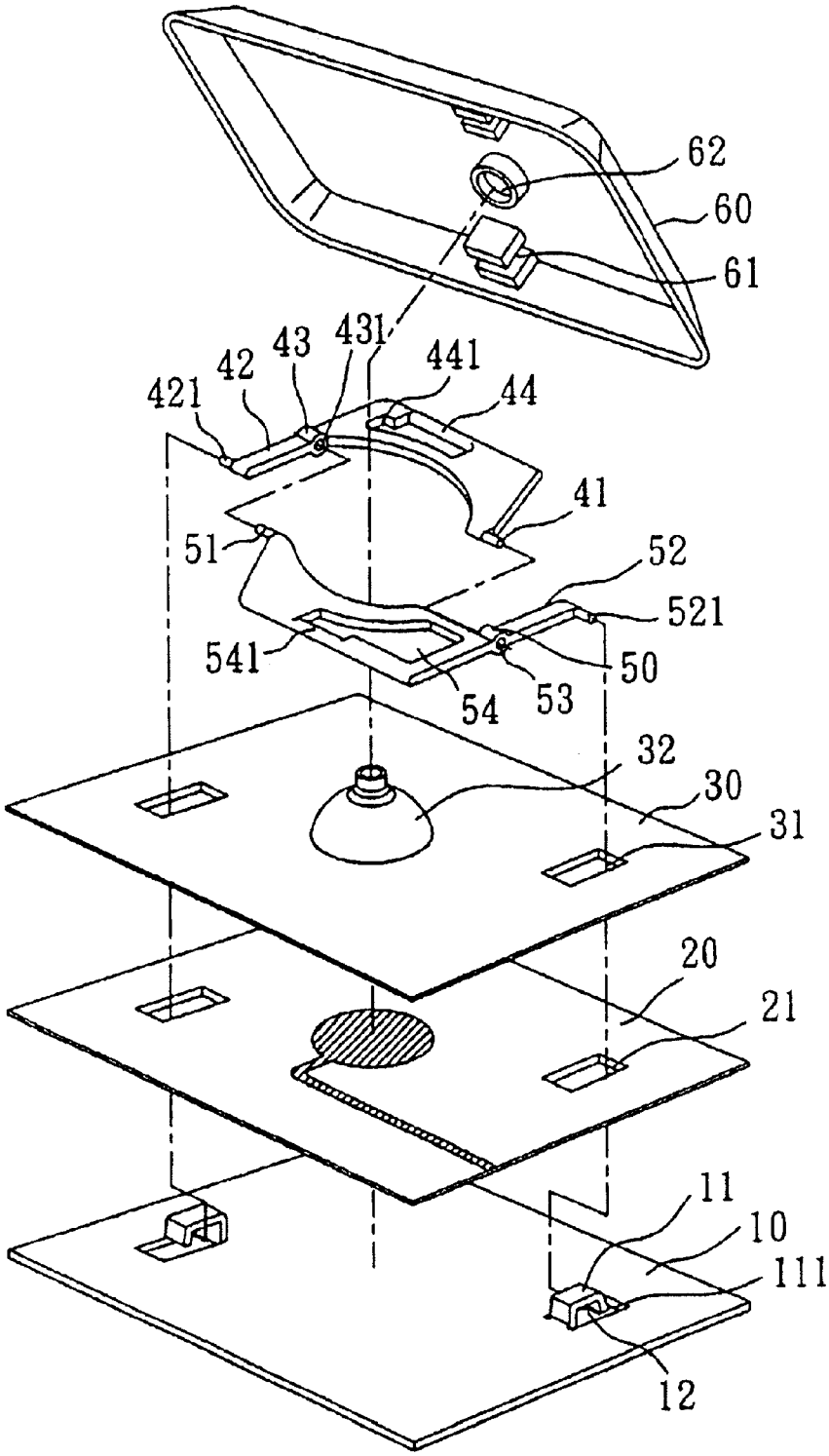
FIG. 2 is an assembly view of the present invention.
Figure 3:
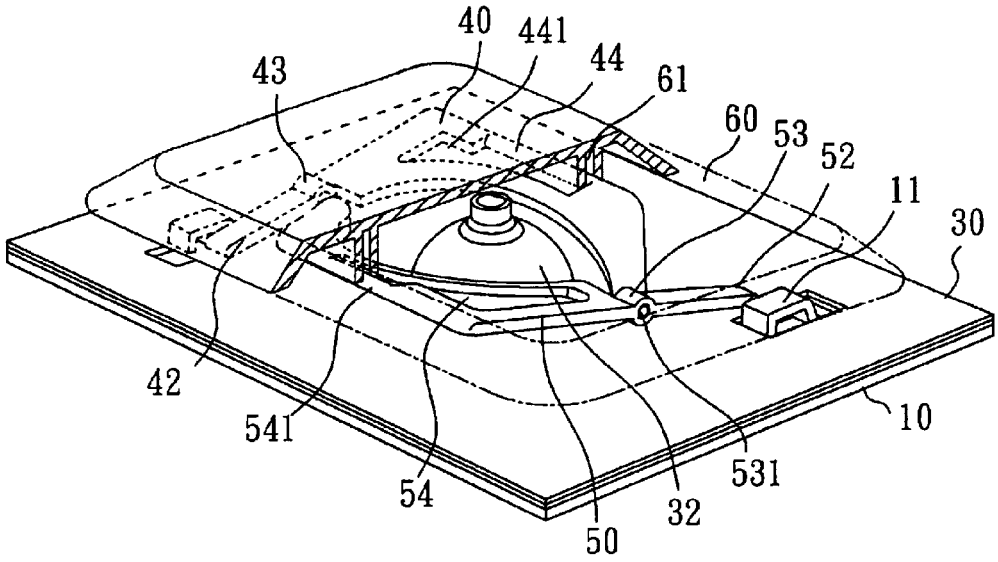
FIG. 3 is a cross-sectional view of the present invention.

As shown in FIG. 2, the structure in the present invention comprises a baseplate 10; the baseplate 10 comprises an inverse "U" shape hood frame 11; the hood frame 11 comprises a gap 111 at one end and an insert hole 12 in the middle; these insert holes 12 are considerably spaced; the baseplate 10 further comprises a membrane circuit board 20; the membrane circuit board 20 is connected with outside via a circuit; a through hole 21 is provided on the membrane circuit board 20 at a location corresponding to the insert hole 12; a pad 30 is stacked over the membrane circuit board 20; an open hole 31 is provided on the pad 30 at a location corresponding to the through hole 21; a resilient body 32 is provided on the pad 30; the resilient body 32 is electrically conductive and round in shape.

Furthermore, a first key frame 40 and a second key frame 50 are on the pad 30; wherein the first key frame 40 and the second key frame 50 comprise two protruding hinged arms 41 and 51 at one end and two extending posts 42 and 52 at the other end; the posts 42 and 52 comprise a shaft lever 421 and 521 respectively; the shaft levers 421 and 521 can thread insert the holes 12 on the hood frame 11; the post 42 is larger than the gap 111 at one end of the hood frame 11; furthermore, the posts 42 and 52 comprise a protruding tubes 43 and 53 where they are connected with the first key frame 40 and the second key frame 50; the tubes 43 and 53 comprise a through holes 431 and 531 through which the hinged arms 51 and 41 thread such that the first key frame 40 and the second key frame 50 can be connected.

Figure 4:
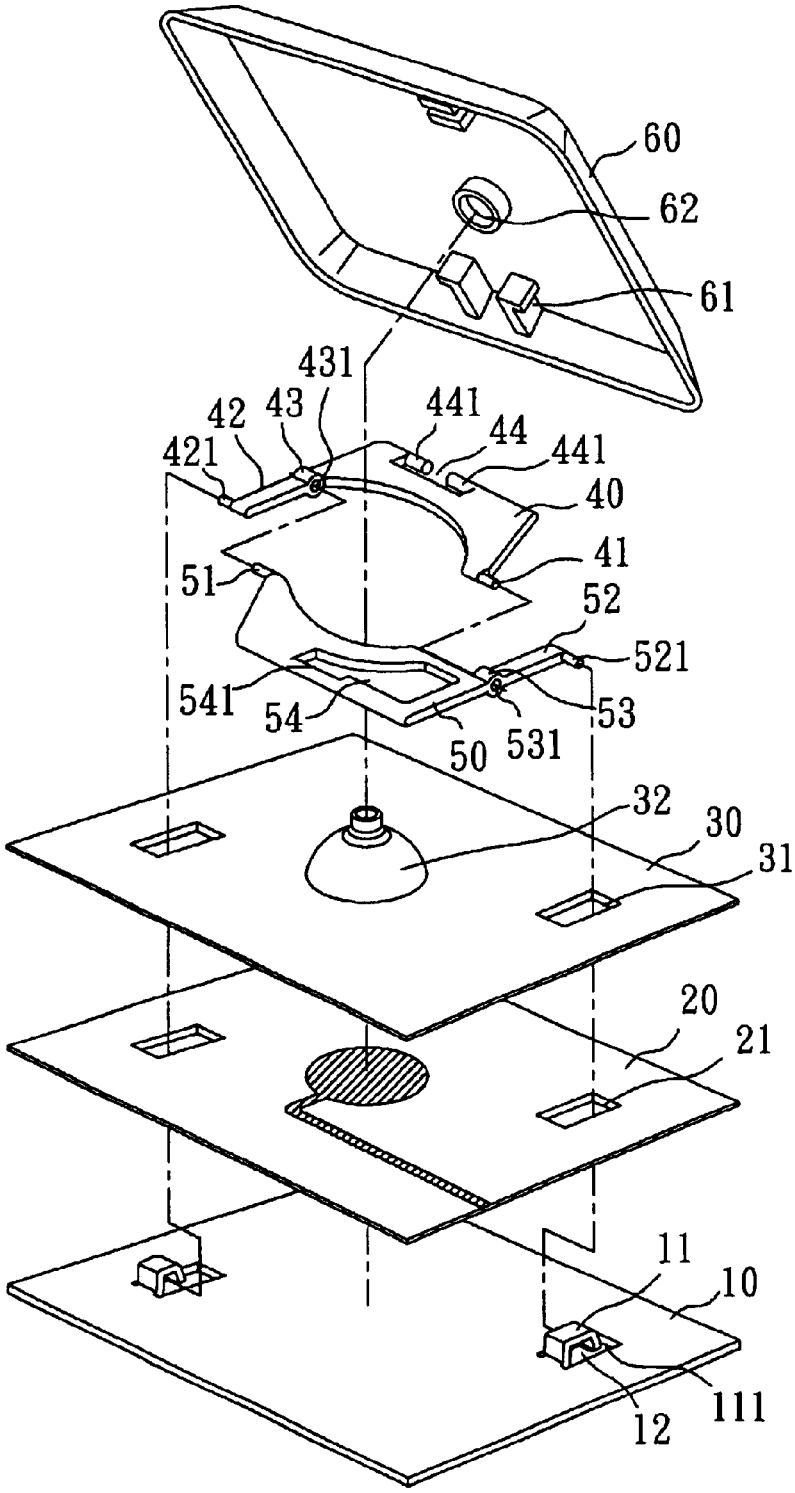
FIG. 4 is a cross-sectional view of the first application the present invention.
Figure 5:
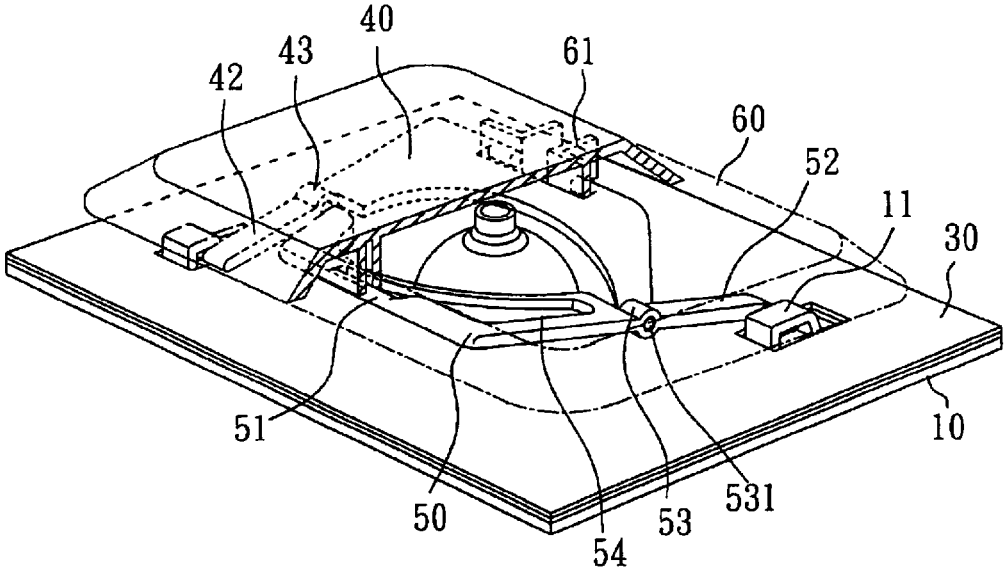
FIG. 5 is a cross-sectional view of the second application the present invention.
Figure 6:
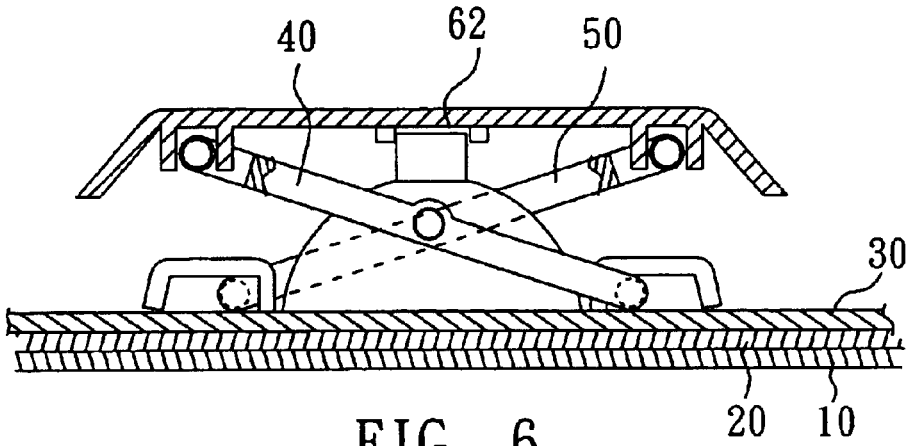
FIG. 6 is an application view of the present invention.
Figure 7:
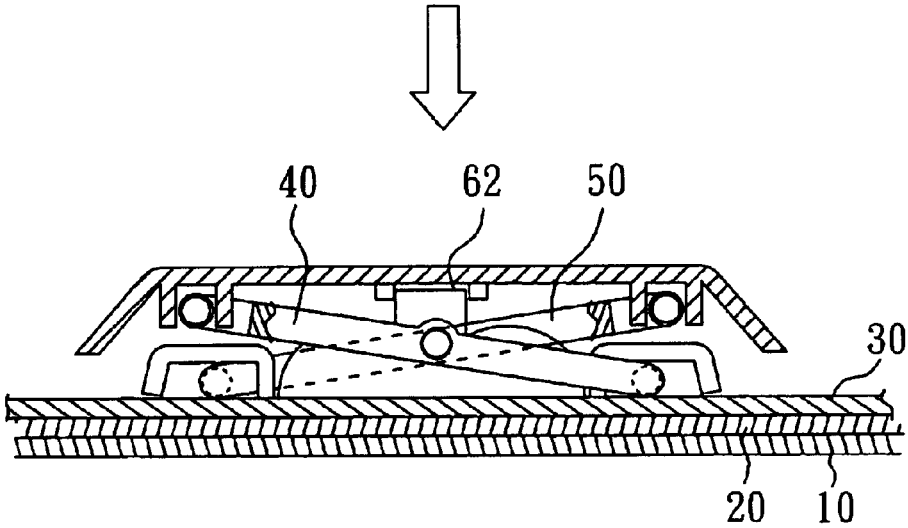
FIG. 7 is another application view of the present invention.

In addition, the first key frame 40 and the second key frame 50 comprise an open grooves 44 and 45 respectively; the open grooves 44 and 54 can be of closed type, as shown in FIG. 2, or open type, as shown in FIG. 4, and can be properly inserted into the insert pedestal 61 on a key cap 60, such that the first key frame 40 and the second key frame 50 that are connected together to stand in "Y" shape between the key cap 60 and the baseplate 10, the insert pedestal 61 can change shape corresponding to the changes in the shape of the open grooves 44 and 54; for example, when open grooves 44 and 54 are in closed status, the insert pedestals 61 are consisted of evenly spaced face-to-face sheets, the edges of the first key frame 40 and the second key frame 50 close to the open grooves 44 and 45 and are inserted between such sheets; however, when the open grooves 44 and 45 are in open status, the insert pedestal 61 are consisted of two "L" shape back-to-back sheets, such that the edges of first key frame 40 and second key frame 50 close to open grooves 44 and 45 and are inserted on such sheets respectively; the open grooves 44 and 45 further comprise a concave section 441 and 541 close to the edges respectively, such that the concave sections 441 and 541 keep the insert pedestal 61 in place without sliding; furthermore, a positioning post 62 is on the key cap 60; the positioning post 62 can properly sleeve around the resilient body 32 and thus keep the resilient body 32 from offset movement.

While assembling, referring to FIG. 2, FIG. 3, FIG. 4, FIG. 5, FIG. 6 and FIG. 7, operators stack the membrane circuit board 20 and the pad 30 on the baseplate 10 first; then insert the first key frame 40, the second key frame 50 and the posts 42, 52 into the insert hole 12 through the open hole 31 and the through hole 21; pass the hinged arms 41 and 51 on the first key frame 40 and the second key frame 50 into the through holes 531 and 431; insert the insert pedestal 61 on the key cap 60 into the concave sections 441 and 541 on the first key frame 40 and the second key frame 50 close to the open grooves 44 and 54;

as a result, the first key frame 40 and the second key frame 50 each has only one post 42 and post 52, to compare with conventional scissor bridging type structure, such structure is easier to install and reduces manufacturing cost; the first key frame 40 and the second key frame 50 are interconnected, drag and support each other, thus increases the supporting force. Furthermore, the baseplate 10 comprises an inverse "U" shape hood frame 11 on the insert hole 12 to prevent drop-off due to slippage after the shaft levers 421 and 521 are inserted in; in addition, since the end surfaces of the first key frame 40 and the second key frame 50 are in arc shape, they not only can increase supporting strength but also fit well with the resilient body 32 to the restrict resilient body 32 without any displacement by pressing.

While a preferred embodiment of the invention has been shown and described in detail, it will be readily understood and appreciated that numerous omissions, changes and additions may be made without departing from the spirit and scope of the invention.

What is claimed is:

1. A keystroke structure (1) comprising:

a baseplate with an inverse "U" shape hood frame, said hood frame comprises an insert hole in the middle being considerably spaced;

a membrane circuit board on said baseplate;

a pad is stacked over said membrane circuit board with a resilient body;

a first key frame and a second key frame are on said pad, said first key frame and said second key frame comprise two protruding hinged arms each at one end and two extending posts each at the other end, said posts comprise a shaft lever respectively, said shaft levers insert the holes on said hood frame of said baseplate, said posts comprise a protruding tubes each where they are connected with said first key frame and said second key frame, said tubes comprise a through holes each which said hinged arms thread such that said first key frame said the second key frame are connected;

a keycap inserted onto said first and said second key frame, the edges of said first key frame and said second key frame are inserted between an insert pedestal.

2. The keystroke structure (1) recited in claim 1, wherein the open grooves of said key cap are open type.

3. The keystroke structure (1) recited in claim 1, wherein the open grooves of said key cap are close type.

4. The keystroke structure (1) recited in claim 1, wherein a gap is on the edge of said hood frame with the size smaller than said shaft levers.

5. The keystroke structure (1) recited in claim 1, wherein a positioning post is on said key cap to sleeve around said resilient body and keep said resilient body from offset movement.

6. The keystroke structure (1) recited in claim 1, wherein said inverse "U" shape hood frame prevents drop-off due to slippage after said shaft levers are inserted in.

7. The keystroke structure (1) recited in claim 1, wherein the end surfaces of said first key frame and said second key frame are in arc shape to increase supporting strength and fit well with said resilient body without any displacement by pressing.

* * * * *